US007861854B2

(12) United States Patent
Sharon et al.

(10) Patent No.: US 7,861,854 B2
(45) Date of Patent: Jan. 4, 2011

(54) CARTRIDGE UNIT FOR A MULTI-COMPARTMENT CONTAINER ASSEMBLY

(75) Inventors: Igal Sharon, Caesaria (IL); Yohanan Maggeni, Lower Galilee (IL)

(73) Assignee: M.L.I.S Projects Ltd IL (US)

( * ) Notice: Subject to any disclaimer, the term of this patent is extended or adjusted under 35 U.S.C. 154(b) by 1135 days.

(21) Appl. No.: 10/592,214

(22) PCT Filed: Mar. 7, 2005

(86) PCT No.: PCT/IL2005/000265

§ 371 (c)(1),
(2), (4) Date: Sep. 8, 2006

(87) PCT Pub. No.: WO2005/084135

PCT Pub. Date: Sep. 15, 2005

(65) Prior Publication Data

US 2007/0199839 A1 Aug. 30, 2007

(30) Foreign Application Priority Data

Mar. 8, 2004 (IL) ..... 160784

(51) Int. Cl.
*B65D 25/08* (2006.01)

(52) U.S. Cl. ..... 206/221; 215/DIG. 8

(58) Field of Classification Search ..... 206/219, 206/220, 221; 215/DIG. 8
See application file for complete search history.

(56) References Cited

U.S. PATENT DOCUMENTS 5,433,328 A 7/1995 Baron et al.
6,135,275 A * 10/2000 Kelders et al. ..... 206/221
6,959,807 B2 11/2005 Sharon et al.
7,083,043 B2 8/2006 Sharon et al.
2003/0024830 A1 2/2003 Sharon et al.
2004/0007481 A1 * 1/2004 Kiser, Jr. ..... 206/219
2004/0089563 A1 5/2004 Sharon et al.
2005/0205438 A1 * 9/2005 Hierzer et al. ..... 206/222
2007/0074979 A1 * 4/2007 Cho ..... 206/219

OTHER PUBLICATIONS

International Search Report for International Publication No. WO 2005/084135, International Application No. PCT/IL2005/000265, International Filing Date Mar. 8, 2005. (2 pages).

* cited by examiner

*Primary Examiner*—Jacob K Ackun, Jr.
(74) *Attorney, Agent, or Firm*—Deborah Gador

(57) ABSTRACT

A cartridge container unit having a compartment for storing a material. The compartment is adapted for separately storing one component of a formulation until ready for mixing with a second component in an assembly unit prior to use. Thus, the cartridge unit allows the user to store a material until ready for use, or to store multiple components of a formulation in separate individually sealed containers until ready for use that can be readily assembled into a single multi-compartment container. The cartridge unit includes a substantially cylindrical housing having a sealable opening at its top end and an opening at its bottom end. The bottom end may be adapted and configured to engage and seal the assembly unit. A first inwardly extending annular shoulder is provided between the sealable opening and the bottom opening, defining a flow passage along a longitudinal axis of the housing.

34 Claims, 12 Drawing Sheets

CARTRIDGE UNIT FOR A MULTI-COMPARTMENT CONTAINER ASSEMBLY

FIELD OF THE INVENTION

The present invention relates to a cartridge container unit in general and, in particular, to a cartridge container unit for storing separately one component of a formulation until ready for mixing prior to use.

BACKGROUND OF THE INVENTION

Multi-compartment container assemblies allowing the user to store multiple components of a formulation in separate, individually sealed containers until ready for use, are known in the art. A cartridge container unit, or a "cartridge unit", for a multi-compartment container assembly that can be assembled into a single multi-compartment container, is disclosed in pending United States Patent Application Publication No. 2003/0024830 A1, filed Aug. 6, 2002, herein "the US Patent Application", which is assigned to the assignee of the present application and whose contents are incorporated by reference. The container assembly disclosed in that application consists of two or more assembly units, at least one of which is a cartridge unit and the other may be a second cartridge unit or a dispensing unit.

A dispensing unit may be a container for storing a component of a formulation with a sealable opening at each end of the container body. A dispensing unit may also be a container for storing a component of a formulation having one closed end and a sealable opening at the second end of the container body. The top end of the dispensing unit may be adapted and configured to engage a dispensing device, such as a nozzle or a nipple of a suitable material for a baby feeding dispensing unit, or a dosage device, etc. The bottom end of the dispensing unit may be adapted and configured to engage a cartridge unit in order to assemble a multi-compartment container. The cartridge unit may be adapted and configured to engage the top or bottom ends of the dispensing unit.

Both ends of the dispensing unit may be sealed so that the dispensing unit's contents can be protected from any contamination during storage. But because these seals must be removed in order to assemble the multi-compartment assembly and dispense the contents, the seals are preferably configured to be readily removed or broken, e.g., a breakable or peelable seal. The breakable or peelable seal may comprise a membrane, where the membrane may be a foil or a non-metallic membrane, such as a plastic or other polymer membrane, and may have a single-layer or a multi-layered laminate structure. Such membrane seal may be heat sealed along the rims of the dispensing unit's open ends so that it may be peeled off to engage a cartridge unit or to attach an appropriate dispensing device or system. The seal may further comprise a screw-on or pressure closing cartridge unit.

A cartridge unit is a container for storing a component of the formulation having an opening at each of its top and bottom ends. The top open end of the cartridge unit may be adapted and configured to sealingly engage the top or bottom opening of a dispensing unit, thereby forming a two-compartment container. To form a two-compartment container, the top end of the cartridge unit is inserted into the flange portion of the dispensing unit, whereby each assembly unit forms a separate compartment of the resulting container.

Within the cartridge unit is provided a sealing wall that forms a fluid-tight seal at or near the top open end of the cartridge unit, sealing the top end opening of the cartridge unit. The sealing wall is axially movable, i.e., along the longitudinal axis of the cartridge unit, between a sealed position, whereby the seal is formed, and an unsealed position, whereby the inside of the cartridge unit is in flow-communication with the dispensing unit through the top open end. The sealing wall is coupled to a displaceable member for axially moving the sealing wall between its sealed position and its unsealed position. Thus, the sealing wall cannot extend into and seal another assembly unit attached to the cartridge unit.

These assembly units can be individually sealed so that a component of a formulation may be stored in each of the assembly units. The assembly units can then be assembled readily into a single multi-compartment container by joining an appropriate number of assembly units together. The separate sealable containers may be assembled together readily to form a single multi-compartment container with each of the assembly units forming a separate compartment, so that the components of the formulation can be kept separated until ready to be mixed.

For example, a dispensing unit and a cartridge unit may be assembled together to form a two-compartment container assembly. By piggy-backing one or more cartridge units to the first cartridge unit in series, additional compartments may be added. Each additional cartridge unit may contain a different component of a formulation in any predetermined quantity. Furthermore, a multi-compartment container may be assembled by connecting multiple cartridge units only, without using any dispensing unit. In such an embodiment, a suitable dispensing device may be attached to the top opening of the first cartridge unit, if necessary. The displaceable member has a sealing wall at its top end and a filling opening near its bottom open end, sealable with a membrane seal. Additional cartridge units may be piggy-backed to the bottom end of the displaceable member in series to form a multi-compartment container. In this configuration, the bottom end of the displaceable member of the first cartridge unit is unsealed by removing the sealing membrane while the cartridge unit is held upside down, and the top end of the second cartridge unit engages the open bottom end of the displaceable member of the first cartridge unit to form a fluid-tight seal, so that each cartridge unit may form a compartment of a two-compartment container. When ready to use, the user manipulates the displaceable member of the second cartridge unit to move the sealing wall to its unsealed position, establishing a flow-communication between the two compartments of the two cartridge units and allowing the components of the formulation to mix together.

Many different combinations of dispensing units and cartridge units may be formed to create any number of different multi-compartment assembly containers for storing a variety of formulations, as for example, formulations for human use in the form of a dry powder which are mixed with a liquid to form a liquid formulation shortly before use. Such formulation, for example, may include various nutritive formulas and a variety of drugs, e.g. antibiotics. The shelf life of such mixed dry powder and liquid formulations is limited, and this dictates the need to prepare the formulation only shortly before use. The limited shelf life of the powder and liquid formulation is a result of a loss of activity of an active ingredient in the formula, accelerated oxidation once in solution, etc.

There is a design concern with the prior art multi-compartment assemblies that, in the assembled state and prior to use, the assemblies be hermetically sealed, so as to prevent, over an extended period of time, pre-mature mixing of liquid or liquid vapor of a component in one assembly unit with a component in a second assembly unit. Another design concern with such multi-compartment container assemblies is that the user should be able to readily inspect the component in any of the assembly units in the assembled state just prior to use, in order to verify its useful condition. Yet another concern with many of the multi-compartment container assemblies is the relatively high cost of manufacturing the cartridge unit and assembly units having a similar function.

Accordingly, there is a long felt need for and it would be very desirable to have a cartridge unit, which provides a substantially hermetic seal in the assembled state. It would also be desirable for the cartridge unit to be designed so as to allow the user to readily inspect the component in the cartridge unit, prior to use. Preferably, at least a portion of the cartridge unit would be relatively inexpensive to manufacture.

SUMMARY OF THE INVENTION

The present invention provides for a cartridge container unit having a compartment for storing a material. According to one embodiment, the compartment is adapted for separately storing one component of a formulation until ready for mixing with a second component in an assembly unit prior to use. Them is thus provided, in accordance with the present invention, a cartridge unit for a multi-compartment container assembly allowing the user to store a material until ready for use, or to store multiple components of a formulation in separate individually sealed containers until ready for use that can be readily assembled into a single multi-compartment container. The cartridge unit includes a substantially cylindrical housing having a sealable opening at its top end and an opening at its bottom end. The bottom end may be adapted and configured to engage and seal the assembly unit. A first inwardly extending annular shoulder is provided between the sealable opening and the bottom opening, defining a flow passage along a longitudinal axis of the housing.

The cartridge unit further includes a substantially cylindrical displaceable member inserted in the top end of the housing, the displaceable member having a sealable opening at its top end, and being adapted and configured to seal the sealable opening of the housing. The cartridge unit has a sealing member adapted for a sealing engagement with internal wall of the first shoulder and defines, together with the inside walls of the top opening of the assembly unit, a compartment in the cartridge unit. The sealing member may be coupled to the displaceable member, or to the housing, as described in detail below. The sealing member preferably includes two sealing ridges. According to one embodiment, the two sealing ridges form a fluid-tight seal between the sealing member and the first annular shoulder, thereby sealing the bottom open end of the cartridge unit, and concurrently, form a fluid-tight seal between the sealing member and the inside walls of the assembly unit.

The displaceable member is axially displaceable between two positions along the longitudinal axis through the cartridge unit, a first position whereby the seal is formed, as a first sealing ridge about the circumference of the sealing member sealingly engages the internal wall of the first shoulder, while a second sealing ridge about the circumference of the sealing member sealingly engages the internal walls of the top opening of the assembly unit; and a second position where the sealing member and the shoulder and the inside walls of the top opening of the assembly unit are disengaged, whereby the compartment inside the cartridge unit is in flow-communication with the assembly unit through the open end of the cartridge unit. This flow communication allows transfer of some or all of the material in the cartridge unit into an empty assembly unit, or vice versa, or mixing of the material in the cartridge unit with a material in the assembly unit to form a mixture which is ready for dispensing. The displaceable member further includes a filling opening with a mating closure member.

The displaceable member and cylindrical housing may be adapted and configured to securely hold the sealing member in the sealed position, as by means of a bayonet lock connection, thus functioning as a security mechanism for preventing unintentional unsealing of the flow passage. When it is desired to provide flow communication between the compartment in the cartridge unit and the bottom open end of the housing, for example, to mix the contents of the compartment with the contents of the assembly unit, or to transfer a material between the compartment in the cartridge unit and the assembly unit, the displaceable member is turned to unlock the bayonet lock, then pulled axially to displace the sealing member relative to the shoulder in the cartridge unit, thereby opening flow communication between the compartment in the cartridge unit and the bottom open end of the housing.

According to one embodiment of the invention, the sealing member may be provided at one end of the displaceable member and a manipulable depending skirt may be provided at the other end. The skirt is adapted and configured to be controlled by a user to move the displaceable member. At least one connecting member couples the skirt and the sealing member.

It is a particular feature of the invention that the cartridge unit has a simple construction which includes a robust seal to prevent liquid and liquid vapors from the assembly unit from passing through the seal and reaching the component in the cartridge unit. According to one embodiment, the cartridge unit permits the user to view the component in the cartridge prior to mixing, in order to ascertain that the component is in good condition.

The present invention also provides a process for preparing a cartridge unit for holding and storing a material, until the cartridge unit is mounted on an assembly unit. The process includes: (a) providing a cartridge unit having a substantially cylindrical housing, a sealable opening at its top end, an inwardly extending annular shoulder defining a flow passage in the cartridge unit, and an opening at its bottom end; (b) inserting a displaceable member within the housing, the housing or the displaceable member having a sealing member adapted for sealing engagement with the annular internal wall of the annular shoulder for sealing the flow passage, thereby defining a compartment in the cartridge unit, the displaceable member movable between a first position whereby a seal is formed between the sealing member and the internal wall of the annular shoulder, and a second position in which the sealing member and the internal wall are disengaged, whereby the compartment inside the cartridge unit is in flow communication with the bottom open end of the housing; the displaceable member having a sealable filling opening at its top end sealable with the closure member; the displaceable member being placed in the cartridge unit in the sealed position.

According to one embodiment, the method further includes (c) introducing a material into the cartridge unit through the sealable filling opening of the displaceable member; and (d) sealing the sealable filling opening.

According to one embodiment of the invention, the fillable opening is sealed by a transparent or translucent hollow closure, which can, itself, hold a material or a component of a mixture.

Once the cartridge unit and the assembly unit are prepared, they can be held separately for extended periods of time until they are ready to be coupled together to mix the contents of each into a mixture. Alternatively, the assembly unit can be sealed by the filled cartridge unit, and the capped assembly unit held until the contents are to be mixed. It will be appreciated that in the assembled state, the cartridge unit and the assembly unit form separate compartments, preventing the contents of each unit from mixing prematurely. Alternatively, either, or all, of the assembly units, can be prepared and held separately while empty, and a material may be added to one or more prior to transfer from one to the other in the assembled state.

BRIEF DESCRIPTION OF THE DRAWINGS

The present invention will be further understood and appreciated from the following detailed description taken in conjunction with the drawings in which.

The drawings are only schematic and are not necessarily to scale.

DETAILED DESCRIPTION OF THE INVENTION

The present invention relates to a cartridge container unit having a compartment for storing a material. The cartridge unit is readily coupled to an assembly unit. An assembly unit for purposes of the present application is a dispensing unit, such as a bottle, or a cartridge unit. The cartridge unit may be combined with one or more assembly units in various combinations to form multi-compartment container assemblies, which allow the user to store multiple components of a formulation in separate individually sealed containers until ready for use. Alternatively, the cartridge unit is readily coupled to an empty assembly unit, i.e., in which no material is stored, for purposes of transferring some or all of the material in the cartridge unit into the assembly unit, and vice versa, when there is flow communication between the cartridge unit and the assembly unit. Some examples of the cartridge unit and the multi-compartment container assemblies are provided to illustrate various specific configurations of the invention. The invention should not be regarded as being limited to these embodiments.

The cartridge unit of the present application is generally used and, therefore described as upside down relative to the cartridge unit of the US patent application, e.g. the top of the cartridge unit of the US patent application is described as the bottom part of the cartridge unit of the present application, and vice versa. It will be appreciated by those having ordinary skill in the art that the cartridge unit may be adapted and configured to sealingly engage the top and/or bottom sides of a dispensing unit.

Figure 1:
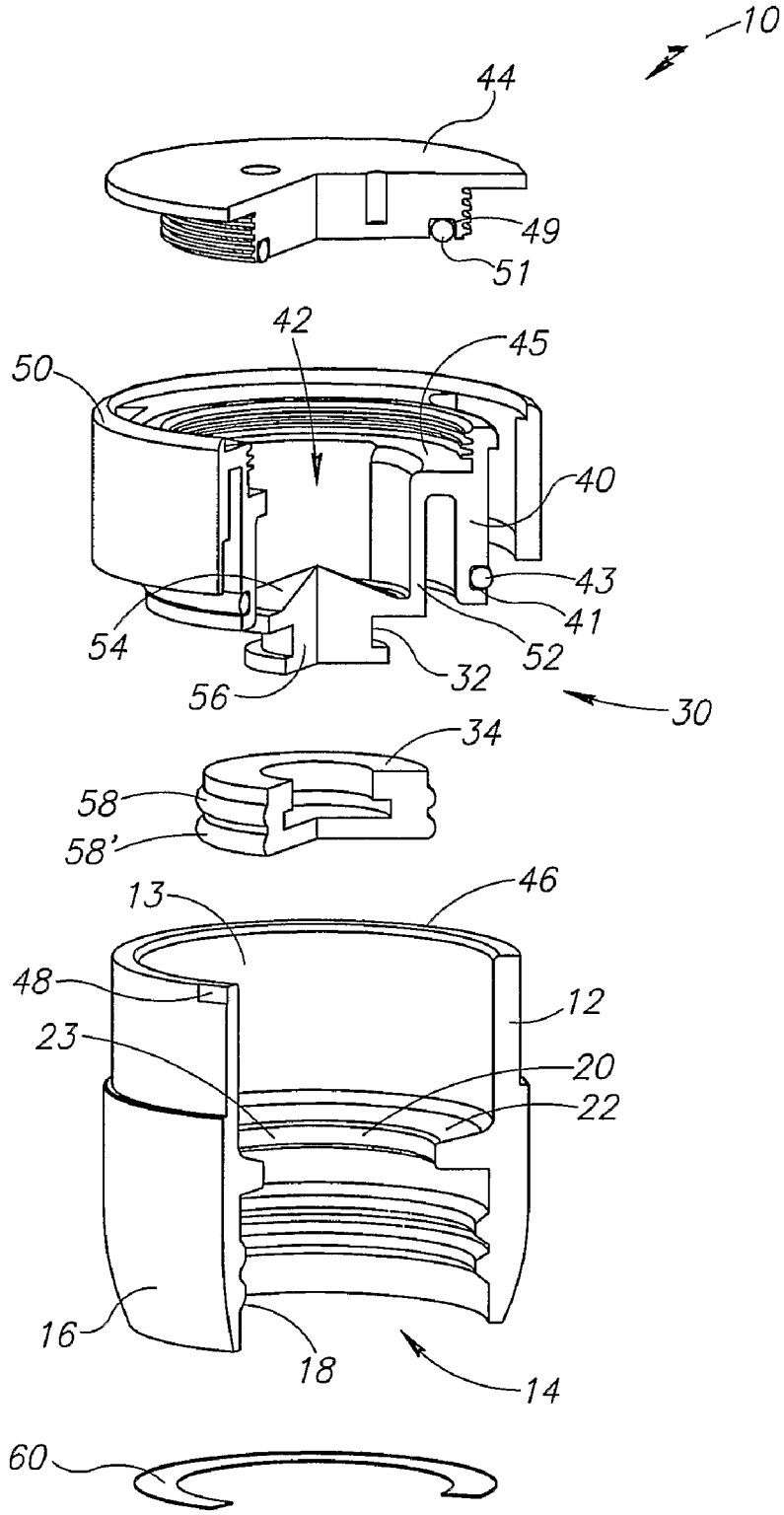
FIG. 1 is a partial cutaway exploded view of a cartridge unit constructed and operative in accordance with one embodiment of the present invention.

FIG. 1 is a partial cutaway exploded view of a cartridge unit 10 constructed and operative in accordance with one embodiment of the present invention. Cartridge unit 10 includes a housing 12 having a sealable top opening 13 and a bottom opening 14. When cartridge unit 10 is sealingly fitted on top of an assembly unit, such as a bottle or jar or a second cartridge unit, a lower portion 16 of housing 12 is coupled about the neck of the assembly unit (not shown). The inner surface of the lower portion 16 of housing 12 is preferably provided with screw threads 18, or a beaded lip, for securely coupling the cartridge unit to complementary screw threads or a protruding flange about the neck of the bottle or jar, respectively, to form a fluid-tight seal. While the invention is illustrated herein with reference to a conventional bottle with a threaded neck, for ease of description, it will be appreciated that the cartridge unit of the invention can be coupled to any assembly unit, by any conventional method.

Housing 12 includes a sealable flow passage 20 between bottom opening 14 and sealable top opening 13. Passage 20 can be sealed with a sealing member 30. Sealable flow passage 20 is formed by a first inwardly extending annular shoulder 22 having an annular internal wall 23. Annular shoulder 22, also serves as a bottom wall defining, together with sealing member 30, the walls of the upper portion of housing 12, and a closure member 44, a sealable compartment 46 in cartridge unit 10 for storing a component. The top surface of shoulder 20 is preferably configured in a downward sloping orientation towards passage 20 for enhancing the sliding of the component in compartment 46 through the flow passage during mixing.

The cartridge unit further includes a displaceable member 40 inserted through the sealable top opening 13 of housing 12. Displaceable member 40 is preferably comprised of a substantially cylindrical sleeve. Displaceable member 40 is adapted and configured to seal top opening 13, passage 20 of housing 12 and the top open end of the assembly unit (not shown). The displaceable member 40 includes a filling opening 42 at its top end, and a mating closure member 44. Closure member 44 is illustrated here as a threaded disc adapted to sealingly engage complimentary threads of opening 42, its top substantially flush with the top of displaceable member 40. When in the closed orientation, closure member 44 rests on, and sealingly engages, a second inwardly extending annular shoulder 45. Preferably, a groove 49 is provided in the bottom surface of closure member 44 for receiving an o-ring 51 to provide a fluid tight seal between closure member 44 and annular shoulder 45. As is further detailed herein below, closure member 44 alternatively may comprise a dispensing device for dispensing the formulation in the container assembly or the component in cartridge unit 10 only, or a hollow closure for holding the component stored in the cartridge unit 10, allowing the user to inspect the condition of the component prior to use.

The top of displaceable member 40 defines a manipulable depending skirt 50. Skirt 50 is manipulated by a user to axially displace the displaceable member 40 in and out of top opening 13. Annular shoulder 45 of displaceable member 40 further serves as a top wall of compartment 46 in cartridge unit 12.

In this embodiment, sealing member 30 forms one end of displaceable member 40. Sealing member 30 is connected to annular shoulder 45 by one or more depending supporting members 52. Sealing member 30 defines a top surface 54, preferably sloping downwardly from its center towards its circumference, and a stem 56 projecting downwardly and having a groove 32 about its circumference for receiving a sealing element 34. Sealing element 34 includes a first sealing ridge 58 and a second sealing ridge 58' disposed below sealing ridge 58. Alternatively, sealing member 30 may be adapted and configured to include two grooves, each receiving a sealing O-ring.

The filling opening 42 of cartridge unit 10 may typically be sealed, after filling, by closure member 44, so that the component in compartment 46 is protected from spilling or any contamination during storage. After mixing and prior to use, closure member 44 may be removed and a dispensing device (not shown) of any shape or form may be coupled to cartridge unit 10, for dispensing of the mixture when displaceable member 40 is in the unsealed position.

Figure 2:
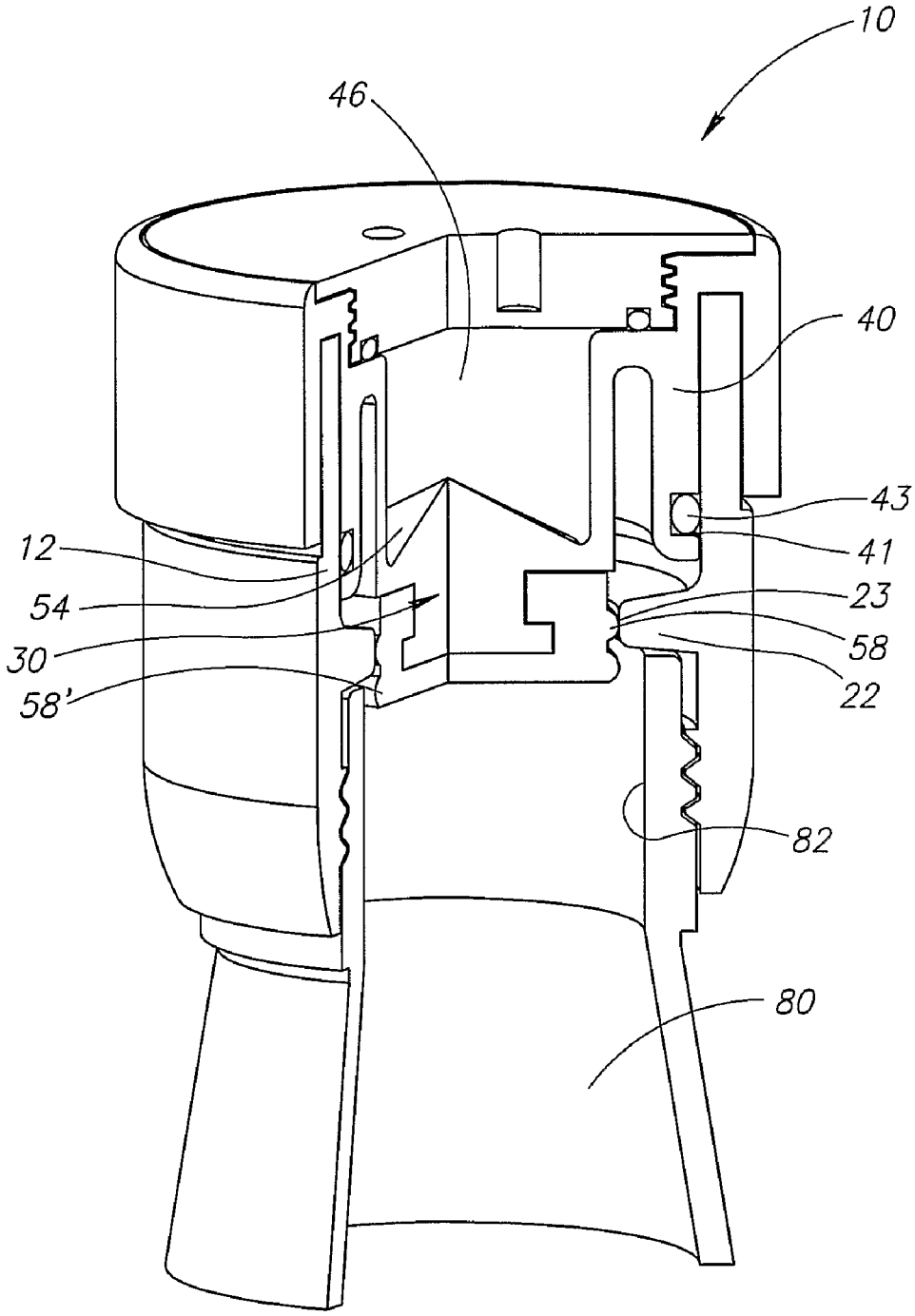
FIG. 2 is a partial cutaway view of the cartridge unit of FIG. 1 as assembled and capping a dispensing unit, in a sealed position.

FIG. 2 is a partial cutaway view of cartridge unit 10 in the sealed position, sealingly coupled to as assembly unit, here illustrated as a dispensing unit 80. As shown in FIG. 2, sealing ridge 58 is adapted and configured for a sealing engagement with internal wall 23 of annular shoulder 22, while sealing ridge 58' is adapted for a concurrent sealing engagement with inside walls 82 of the top opening of the dispensing unit 80. While displacing member 40 is in the sealed position, top surface 54 of sealing member 30 defines the bottom wall of compartment 46 within housing 12 of the cartridge unit 10. Compartment 46 can hold any desired component of a mixture which may later be mixed with a liquid or other second component stored in the assembly unit=, or may hold a material which may later be transferred to an empty assembly unit Sealing ridge 58 provides a fluid-tight seal between sealing member 30 and annular wall 23 of shoulder 22, thereby sealing flow passage 20, while sealing ridge 58' provides a fluid-tight seal between sealing member 30 and walls 82 of the top opening of dispensing unit 80, thereby sealing off dispensing unit 80.

Displaceable member 40 is axially displaceable between two positions along a longitudinal axis through cartridge unit 10, a first position wherein sealing passage 20 is sealed, and a second position wherein sealing passage 20 is unsealed. When cartridge unit 10 is mounted on dispensing unit 80, axially moving displaceable member 40 into the unsealed position provides for a flow-communication between compartment 46 inside cartridge unit 10 through open end 14, and the top opening of dispensing unit 80. This flow-communication allows for mixing of the component in the cartridge unit with the component in the dispensing unit to form a formulation which is ready for dispensing, or for transferring of part, or all, of a material from the cartridge unit into the dispensing unit, or vice versa.

For a better sealing engagement between the cartridge unit 10 and dispensing unit 80, a sealing ring 60 is disposed against the bottom surface of annular shoulder 22 inside cartridge unit 10 (FIG. 1) for sealingly engaging the upper surface of top opening of dispensing unit 80 when assembled, to form a liquid-tight coupling.

As illustrated in FIGS. 1 and 2, displaceable member 40 preferably may be provided with a sealing o-ring 43 disposed within a circumferential groove 41 in the external wall of displaceable member 40, for sealing engagement with the inside surface of housing 12. Sealing o-ring 43 preferably forms a liquid-tight seal between the external walls of displaceable member 40 and the internal walls of housing 12, so that the liquid in the container assembly comprising cartridge unit 10 and dispensing unit 80 does not leak when displaceable member 40 is in the unsealed position. Sealing member 34 and o-ring 43 may be fabricated of elastomeric material as integral parts of displaceable member 40 in a process of "double injection", as known, to enhance sealing, and preferably are air-permeable to prevent vacuum pressure from building up inside cartridge unit 10. Sealing o-ring 43 is also adapted and configured to stabilize the movement of displaceable member 40 in cartridge unit 10.

It is a particular feature of this embodiment of the invention that a double seal is provided to enhance the seal between the cartridge unit and the assembly unit, thereby preventing liquid and/or liquid vapor of a first component in a first compartment from passing through the seal and mixing with a second component in a second compartment, prior to use.

Housing 12 and displaceable member 40 may further be adapted and configured to include a security mechanism whereby inadvertent displacement of displaceable member 40 is prevented. Such a security measure will prevent inadvertent unsealing of the fluid-tight seals between sealing element 34 and annular shoulder 22 and the top opening of the dispensing unit 80. In the embodiment illustrated in FIG. 1, this is accomplished by means of a bayonet lock connection.

Figure 3:
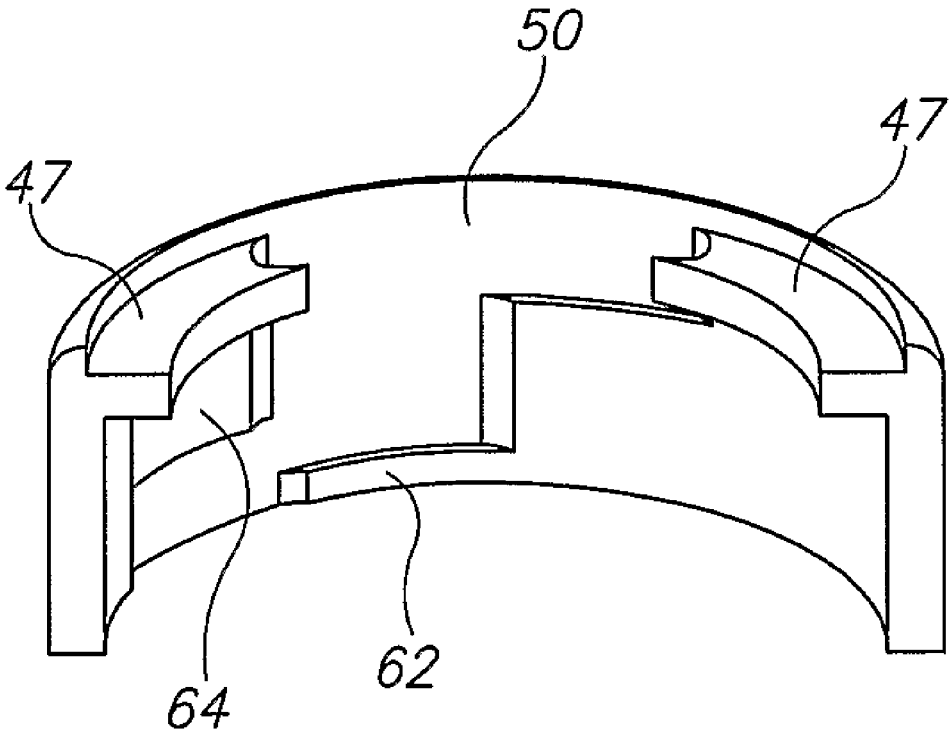
FIG. 3 is a partial cutaway view of the inside surface of a skirt of the cartridge unit of FIG. 1.

In FIG. 3 there is shown a partial cutaway view of skirt 50 of displaceable member 40. By rotating skirt 50, a plurality of bayonet lock hooks 47, extending inwardly from the internal wall of skirt 50, engage complementary protrusions 48 (seen most clearly in FIG. 1) which extend outwardly from the external wall of housing 12. When it is desired to mix the component in compartment 46 with the component in dispensing unit 80, displaceable member 40 is turned to unlock the bayonet lock and then pulled axially up until protrusions 48 abut against a plurality of protrusions 62 which extend inwardly from the internal wall of skirt 50 and are disposed lower than lock hooks 47. Protrusions 62 stop displaceable member 40 from being completely pulled out of housing 12, inadvertently. When protrusions 48 abut against protrusions 62, cartridge unit 10 can be disassembled, if desired, by turning skirt 50 until protrusions 48 are positioned adjacent passages 64 in protrusions 62, and pulling displaceable member 40 out of housing 12.

Figure 4:
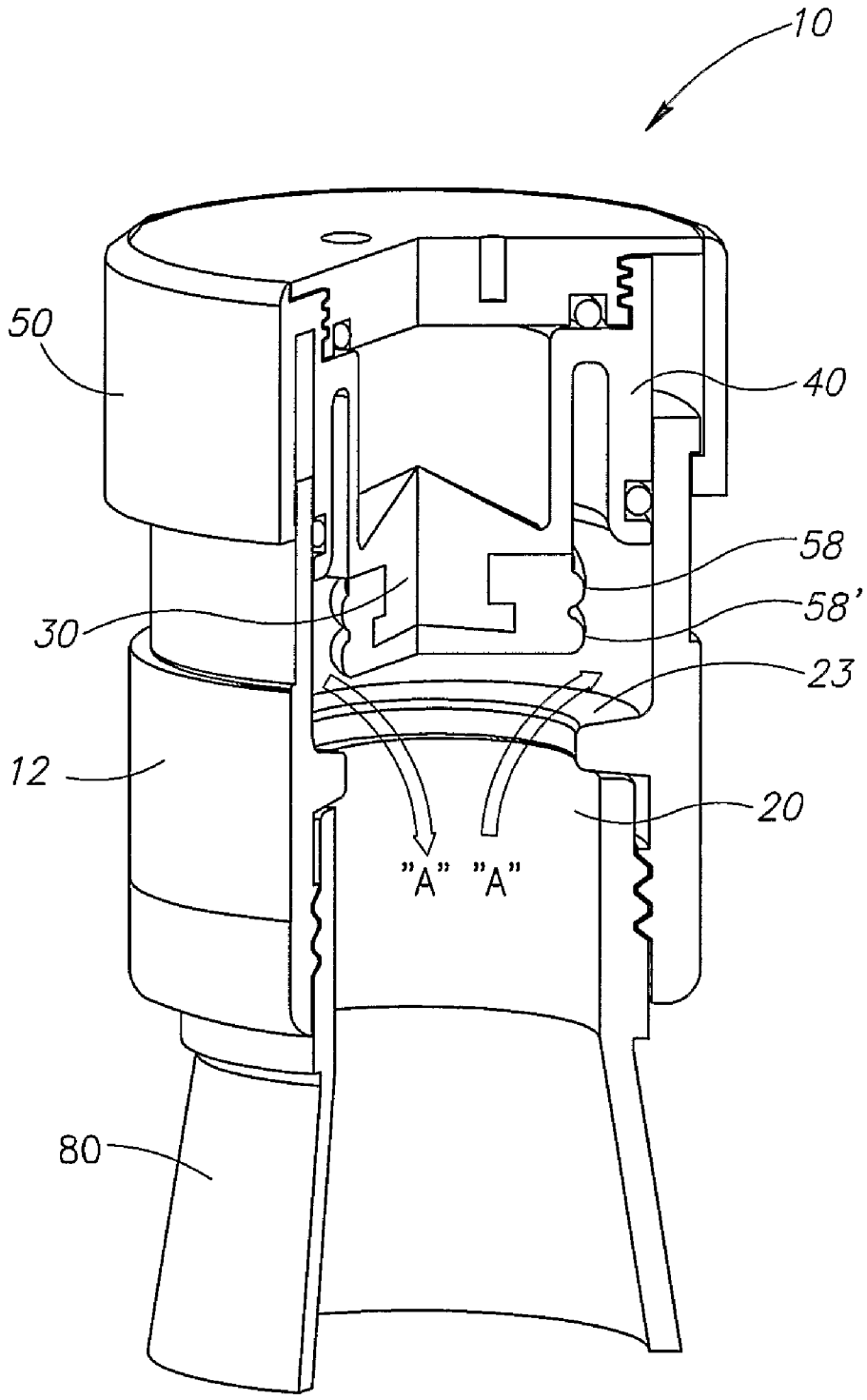
FIG. 4 is a partial cutaway illustration of the cartridge unit of FIG. 2, in a flow communication position.

FIG. 4 illustrates a partial cutaway view of a cartridge unit 10 and dispensing unit 80, assembled as a two-compartment container assembly, wherein the displaceable member 40 is in the unsealed position. Axial upward displacement of displaceable member 40 disengages sealing ridge 58 from internal wall 23 of shoulder 22, thereby opening passage 20, and concurrently, sealing ridge 58' from walls 82 of top open end of dispensing unit 80, thereby providing a flow-communication between cartridge unit 10 and dispensing unit 80 represented by arrows "A".

Figure 5:
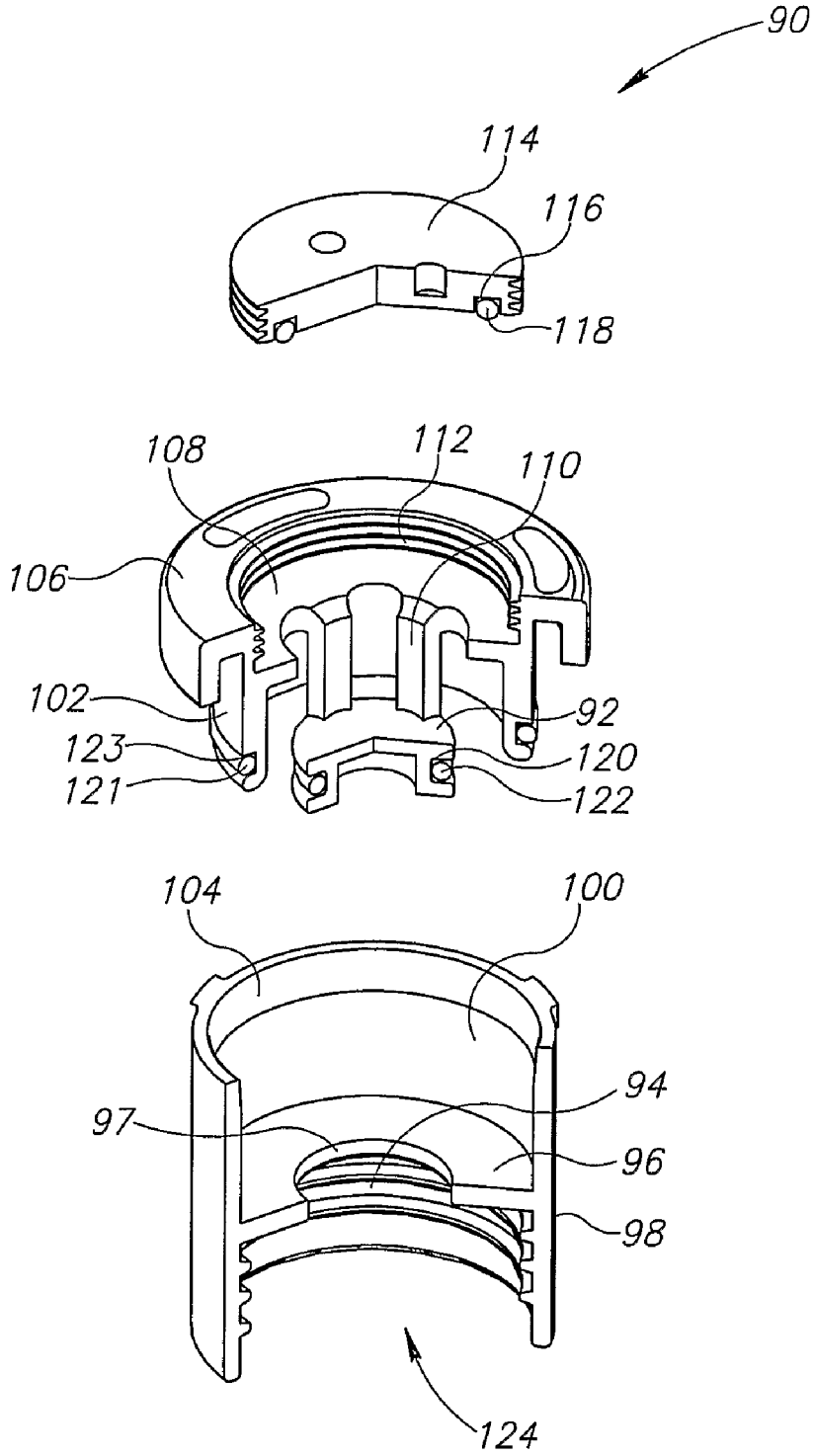
FIG. 5 is a partial cutaway exploded view of a cartridge unit constructed and operative in accordance with an alternative embodiment of the present invention.

FIG. 5 illustrates a partial cutaway exploded view of a cartridge unit 90 according to another embodiment of the invention. Cartridge unit 90 is generally constructed and operative in a similar manner to cartridge unit 10 described above, except for the sealing member. In the embodiment of FIG. 5, the sealing member is a sealing disc 92 for sealing passage 94. Sealable flow passage 94 is formed by a first inwardly extending annular shoulder 96 having an annular internal wall 97. Annular shoulder 96 serves as a bottom wall defining, together with sealing disc 92 and the walls of the upper portion of housing 98, a sealable compartment 100 in cartridge unit 90 for holding a component.

Cartridge unit 90 further includes a displaceable member 102 inserted in the sealable top opening 104 of housing 98. Displaceable member 102 is preferably comprised of a substantially cylindrical sleeve. Displaceable member 102 is adapted and configured to seal both the sealable opening 104 and passage 94 of housing 98. The top of housing 98 defines a depending skirt 106. Skirt 106 is adapted and configured to be controlled by a user to move the displaceable member 102. Displaceable member 102 further includes a second inwardly extending annular shoulder 108 which serves as a top wall of the compartment in cartridge unit 90. Annular shoulder 108 is connected to the sealing disc 92 by one or more depending supporting members 110.

Displaceable member 102 has a filling opening 112 at its top end, with a mating closure member 114. Closure member 114 is illustrated here as a threaded disc adapted to sealingly engage opening 112, its top substantially flush with, or slightly inset from, the top of displaceable member 102. When in the closed orientation, closure member 114 rests on, and sealingly engages, annular shoulder 108. Preferably, a groove 116 is provided in the bottom surface of closure member 114 for receiving an o-ring 118 to provide a fluid tight seal between closure member 114 and annular shoulder 108.

Sealing disc 92 forms one end of displaceable member 102. Sealing disc 92 defines a depending track 120 about its circumference for receiving an o-ring 122, adapted for a sealing engagement with internal wall 97 of the annular shoulder 96, thereby forming the bottom wall of a compartment 100 within housing 98 of cartridge unit 90. Compartment 100 can hold any desired component of a mixture which will later be mixed with a liquid or other second component in an assembly unit. O-ring 122 provides a fluid-tight seal between sealing disc 92 and internal wall 97 of annular shoulder 96, thereby sealing flow passage 94.

The displaceable member is axially displaceable between two positions along a longitudinal axis through the cartridge unit, a first position wherein the o-ring 122 about the circumference of the sealing disc 92 sealingly engages the internal wall 97 of the annular shoulder 96, thereby sealing passage 94, and a second position wherein the sealing disc 92 is disengaged from internal wall 97 of shoulder 96, thereby unsealing flow passage 94. When cartridge unit 90 is mounted on an assembly unit, displacing displaceable member 102 to the second position provides flow-communication between the dispensing unit and compartment 100 inside the cartridge unit through the open end 124 of the cartridge unit. This flow-communication allows mixing of the component in the cartridge unit with the component in the dispensing unit to form a mixture which is ready for dispensing, or for transferring of part, or all, of a material from the cartridge unit into the asasembly unit, or vice versa. The displaceable member 102 preferably may be provided with a sealing o-ring 121 disposed within a circumferential groove 123 in the external wall of displaceable member 102, for sealing engagement with the inside surface of housing 98. Sealing o-ring 121 preferably forms a liquid-tight seal between the external walls of displaceable member 102 and the internal walls of housing 98, so that the liquid in the container assembly comprising cartridge unit 90 and assembly unit (not shown) does not leak when displaceable member 102 is in the unsealed position. O-ring 121 may be fabricated of elastomeric material as an integral part of displaceable member 102, o-ring 122 may also be formed of elastomeric material as an integral part of sealing disc 92, in a process of "double injection" to enhance sealing, and preferably these o-rings are air-permeable to prevent vacuum pressure from building up inside cartridge unit 90. Sealing o-ring 121 is also adapted and configured to stabilize the movement of displaceable member 102 in cartridge unit 90.

Figure 6:
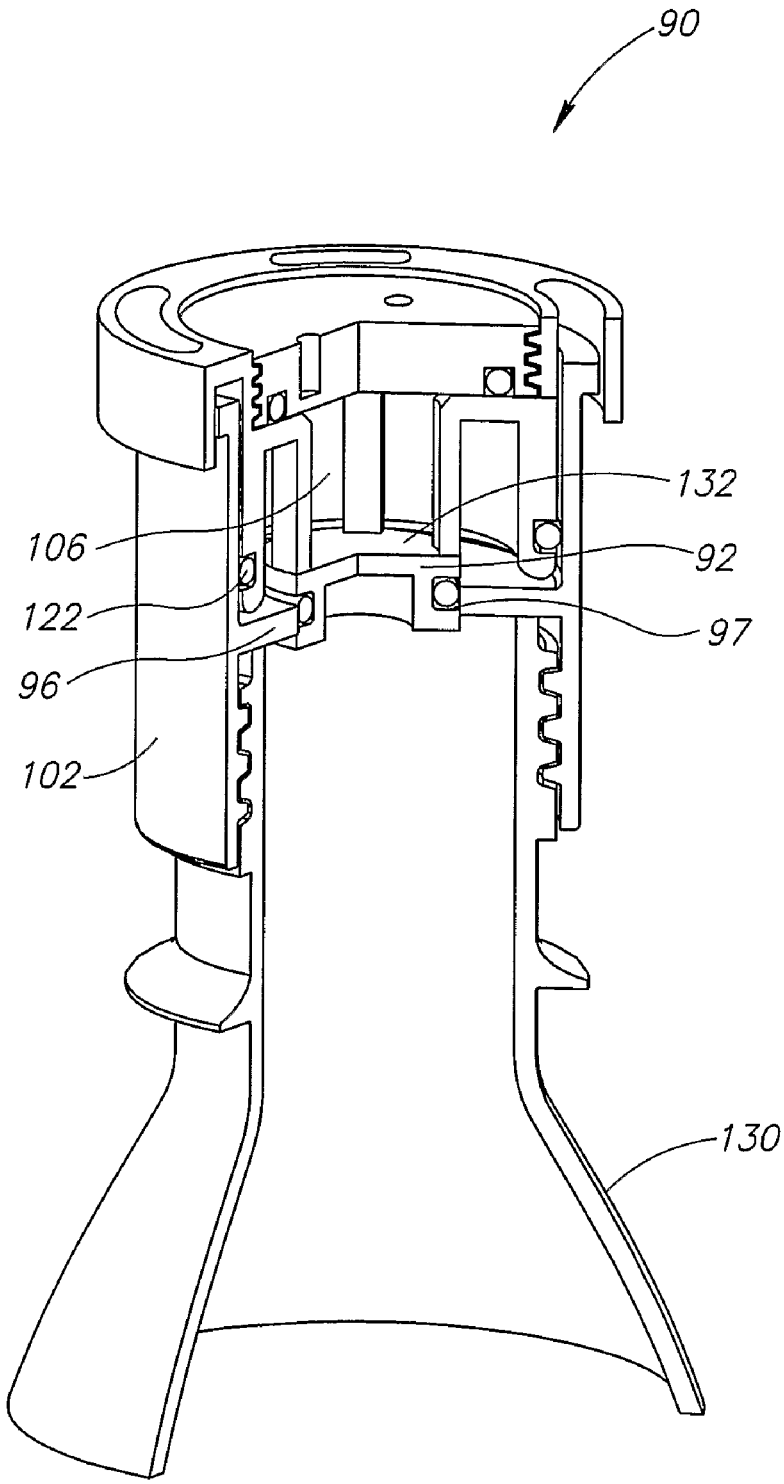
FIG. 6 is a partial cutaway view of the cartridge unit of FIG. 5 as assembled and capping a dispensing unit, in a sealed position.

FIG. 6 is a partial cutaway view of cartridge unit 90 as assembled and in the sealed position, sealingly coupled to an assembly unit, here illustrated as a dispensing unit 130. As seen in FIG. 6, sealing disc 92 is adapted and configured for a sealing engagement with internal wall 97 of annular shoulder 96. While displacing member 102 is in the sealed position, top surface 132 of sealing disc 92 defines the bottom wall of compartment 106 within housing 102 of the cartridge unit 90. Compartment 102 can hold any desired component of a mixture which may later be mixed with a liquid or other second component stored in the assembly unit. Sealing o-ring 122 provides a fluid-tight seal between sealing disc 92 and internal wall 97 of shoulder 96, thereby sealing flow passage 94 (shown in FIG. 5) and preventing flow-communication between cartridge unit 90 and dispensing unit 130. Housing 98 and displaceable member 102 may further be adapted and configured to include a security mechanism to prevent inadvertent displacement of displaceable member 102, in a substantially similar manner as illustrated in FIG. 3 and described above.

Figure 7:
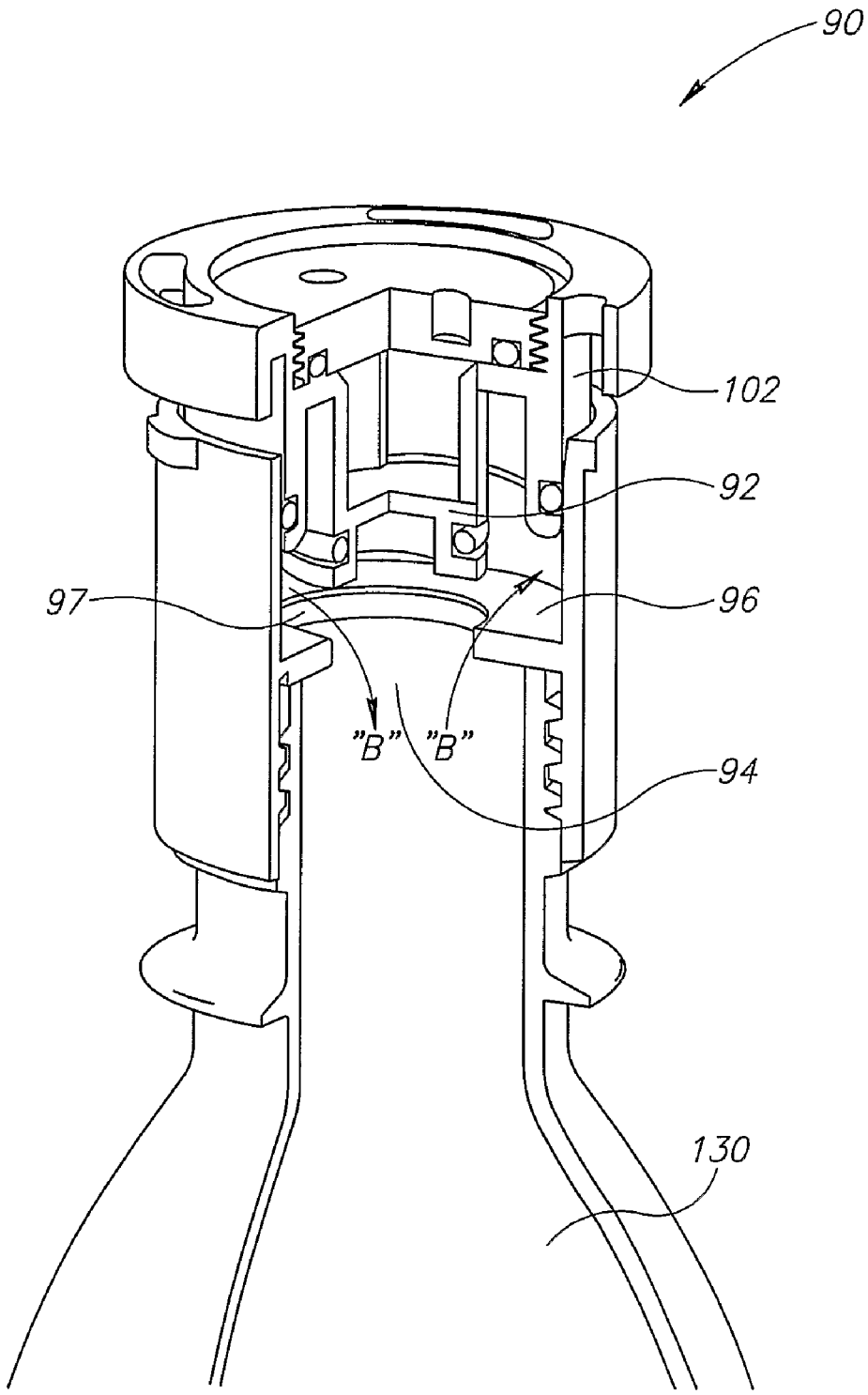
FIG. 7 is a partial cutaway illustration of the cartridge unit of FIG. 6, in a flow communication position.

FIG. 7 illustrates a partial cutaway view of cartridge unit 90 and dispensing unit 130, assembled as a two-compartment container assembly, wherein the displaceable member 102 is in the unsealed position. Axial upward displacement of displaceable member 102 disengages sealing disc 92 from internal wall 97 of shoulder 96, thereby opening passage 94 and providing a flow-communication, represented by arrows "B", between cartridge unit 90 and dispensing unit 130.

Figure 8:
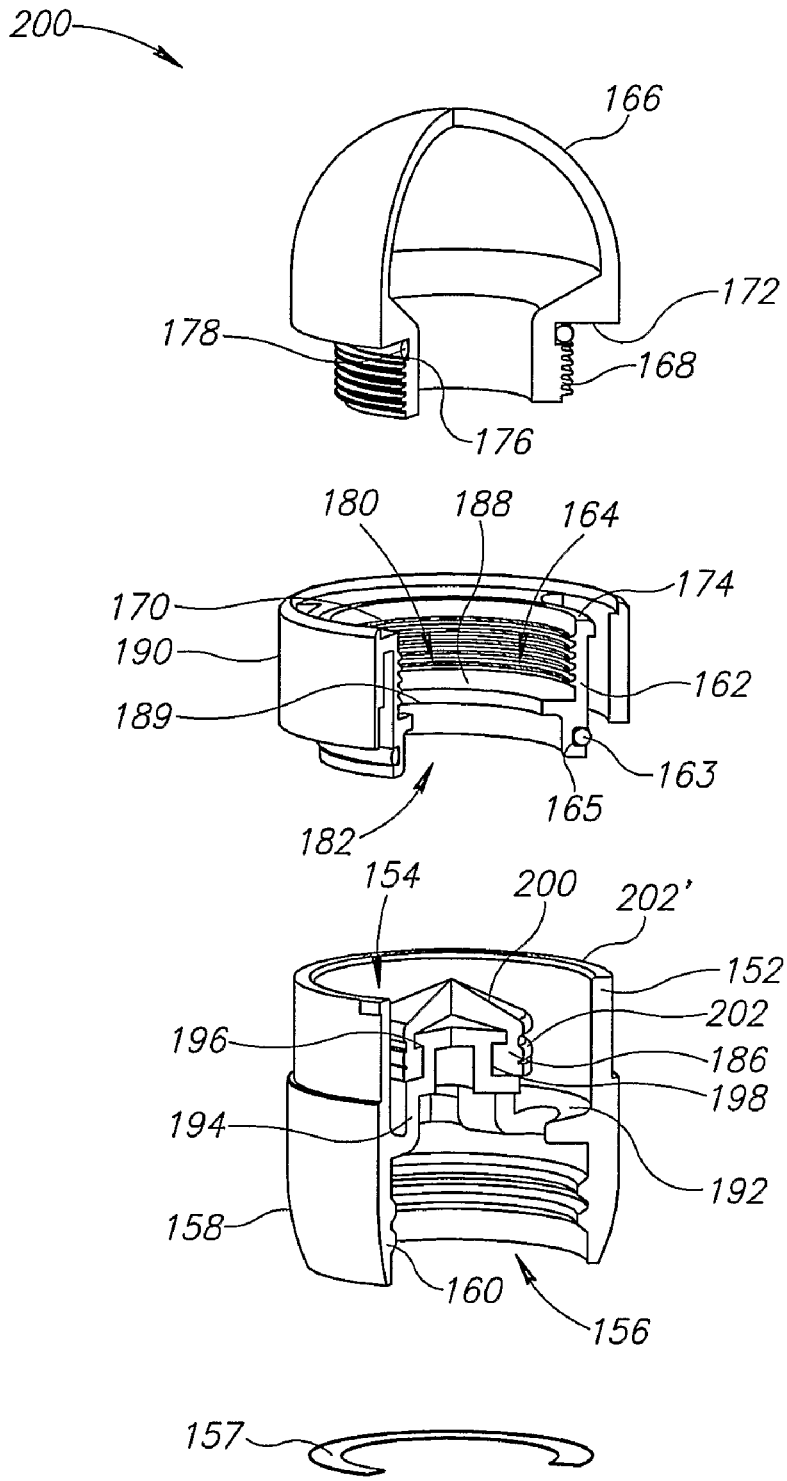
FIG. 8 is a partial cutaway exploded view of a cartridge unit constructed and operative in accordance with another embodiment of the present invention.

FIG. 8 illustrates a partial cutaway exploded view of a cartridge unit 150 according to yet another embodiment of the invention. Cartridge unit 150 includes a housing 152 having a sealable top opening 154 and a bottom opening 156. When cartridge unit 150 is sealingly fitted on top of an assembly unit, a lower portion 158 of housing 152 is coupled about the neck of the assembly unit (not shown); The inner surface of the lower portion 158 of housing 152 is preferably provided with screw threads 160, or a beaded lip, for securely coupling the cartridge unit to complementary screw threads or a protruding flange about the neck of the bottle or jar, respectively, to form a fluid-tight seal.

The cartridge unit further includes a displaceable member 162 inserted through the sealable top opening 154 of housing 152. Displaceable member 162 is preferably comprised of a substantially cylindrical sleeve. Displaceable member 162 is adapted and configured to seal top opening 154 of housing 152. In the embodiment of FIG. 8, the displaceable member 162 includes a filling opening 164 at its top end, and a mating hollow closure member 166, here illustrated as a dome closure, having a depending threaded neck 168. Threaded neck 168 is adapted and configured for sealing engagement with complimentary threads 170 of opening 164.

Those skilled in the art will appreciated that the hollow closure member may have any shape or form as long as it has an open lower portion, preferably threaded, adapted and configured to sealingly engage the filling opening of the displaceable member. Thus, the hollow closure member may be adapted and configured to hold a material or component of a mixture. Preferably, the hollow closure member is transparent or translucent to permit viewing of the material inside.

When in the closed orientation, base 172 of hollow closure 166 rests on top surface 174 of displacement member 162 and sealingly engages opening 164. Preferably, a groove 176 is provided in the upper portion of neck 168 for receiving an o-ring 178 to provide a fluid tight seal between hollow closure 166 and filling opening 164. It will be appreciated that, coupling of dome 166 to displaceable member 162 can be alternatively accomplished by coupling one end of a threaded cylindrical member (not shown) to complimentary threads 170 of filling opening 164, and coupling the second end of the threaded member to complimentary threads of the opening of the bottom end of closure dome 166. In another embodiment, the threaded member may form an integral part of filing opening 164.

The displaceable member 162 includes a sealable flow passage 182. Sealable flow passage 182 is formed by a first annular shoulder 188 extending inwardly from the wall of displaceable member 162 beneath threads 170. First annular shoulder 188 includes an annular internal wall 189. Passage 182 can be sealed with a sealing member 186 to form a sealable compartment 180 in cartridge unit 150, between the walls of the upper portion of displaceable member 162, neck 168 and hollow closure 166, for storing a component. Hollow closure 166 may be used for storing the component of cartridge unit 150 prior to use.

It will be appreciated that the hollow closure described and illustrated in FIG. 8 can also be used to replace the closure members in the embodiments of the cartridge unit described above. Similarly, a disc closure member can alternatively be used instead of hollow closure member 166 in the embodiment of FIG. 8. It will further be appreciated that alternatively the closure member may comprise a membrane, such as a foil or a plastic membrane, or other polymer membrane, as known. Such membrane seal may be heat sealed along the rims of the top open end of the displaceable member and it may be peeled off to engage an appropriate dispensing device, as desired. The top of displaceable member 162 defines a depending skirt 190. Skirt 190 is manipulated by a user to axially displace the displaceable member 162 in and out of top opening 154. In this embodiment, sealing member 186 is connected to a second annular shoulder 192 extending inwardly from the wall of housing 152 by one or more supporting members 194. Sealing member 186 includes a stem 196 projecting upwardly towards flow passage 182 and having a groove 198 about its circumference for receiving a sealing element 200. Sealing element 200 includes a first sealing ridge 202 and a second sealing ridge 202' disposed above sealing ridge 202. Alternatively, sealing member 200 may be adapted and configured to include two grooves, each receiving a sealing O-ring. For a better sealing engagement between the cartridge unit 200 and an assembly unit, here shown as a dispensing unit 220, a sealing ring 157 is disposed against the bottom surface of annular shoulder 192 inside cartridge unit 200 for sealingly engaging the upper surface of top opening of dispensing unit 220 when assembled, to form a liquid-tight coupling.

As seen in FIG. 8, displaceable member 162 preferably may be provided with a sealing o-ring 163 disposed within a circumferential groove 165 in the external wall of displaceable member 162, for sealing engagement with the inside surface of housing 152. Sealing o-ring 163 preferably forms a liquid-tight seal between the external walls of displaceable member 162 and the internal walls of housing 152, so that the liquid in the container assembly comprising cartridge unit 200 and dispensing unit 220 does not leak when displaceable member 162 is in the unsealed position. Sealing member 186 and o-ring 163 may be fabricated of elastomeric material in a process of "double injection", as known, to enhance sealing, and preferably are air-permeable to prevent vacuum pressure from building up inside cartridge unit 200. Sealing o-ring 163 is also adapted and configured to stabilize the movement of displaceable member 162 in cartridge unit 200.

Housing 152 and displaceable member 162 may further be adapted and configured to include a security mechanism for preventing inadvertent displacement of displaceable member 162, in a substantially similar manner as illustrated in FIG. 3 and described above.

Figure 9:
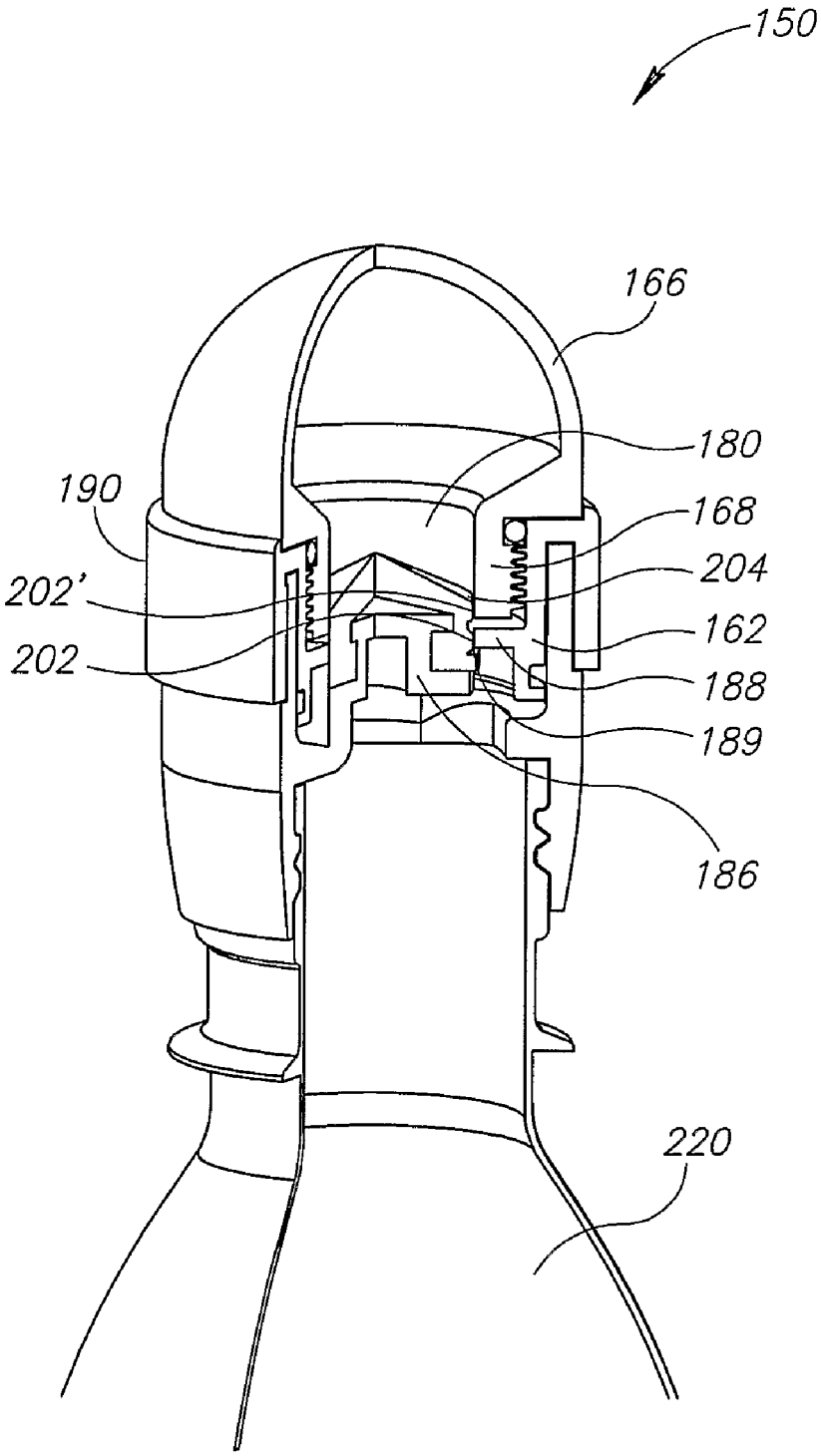
FIG. 9 is a partial cutaway view of the cartridge unit of FIG. 8 as assembled and capping a dispensing unit, in a sealed position.

FIG. 9 is a partial cutaway view of cartridge unit 200 in the sealed position, sealingly coupled to a dispensing unit 220. As shown in FIG. 9, sealing ridge 202 is adapted and configured for a sealing engagement with internal wall 189 of annular shoulder 188, while sealing ridge 202' is adapted for a concurrent sealing engagement with inside walls 204 of neck 168 at the opening of hollow closure 166. While displacing member 162 is in the sealed position, the top surface of sealing member 186 together with annular shoulder 188 define the bottom wall of compartment 180 within displaceable member 162 and hollow closure 166 of the cartridge unit 150. Compartment 180 can hold any desired component of a mixture which may later be mixed with a liquid or other second component stored in dispensing unit 220, or may hold a material which may later be transferred to the dispensing unit 220, or vice versa.

It will be appreciated that, in the event that cartridge unit 150 is sealingly coupled to an assembly unit having a removable seal on its top end opening, the bottom surface of sealing member 186 together with the bottom surface of annular shoulder 188 may define the top wall of a third compartment, between compartment 180 and the compartment in the assembly unit.

Sealing ridge 202 provides a fluid-tight seal between sealing member 186 and internal wall 189 of shoulder 188, thereby sealing flow passage 182, while sealing ridge 202' provides a fluid-tight seal between sealing member 186 and inside walls 204 of neck 168 at the opening of hollow closure 166.

Figure 10:
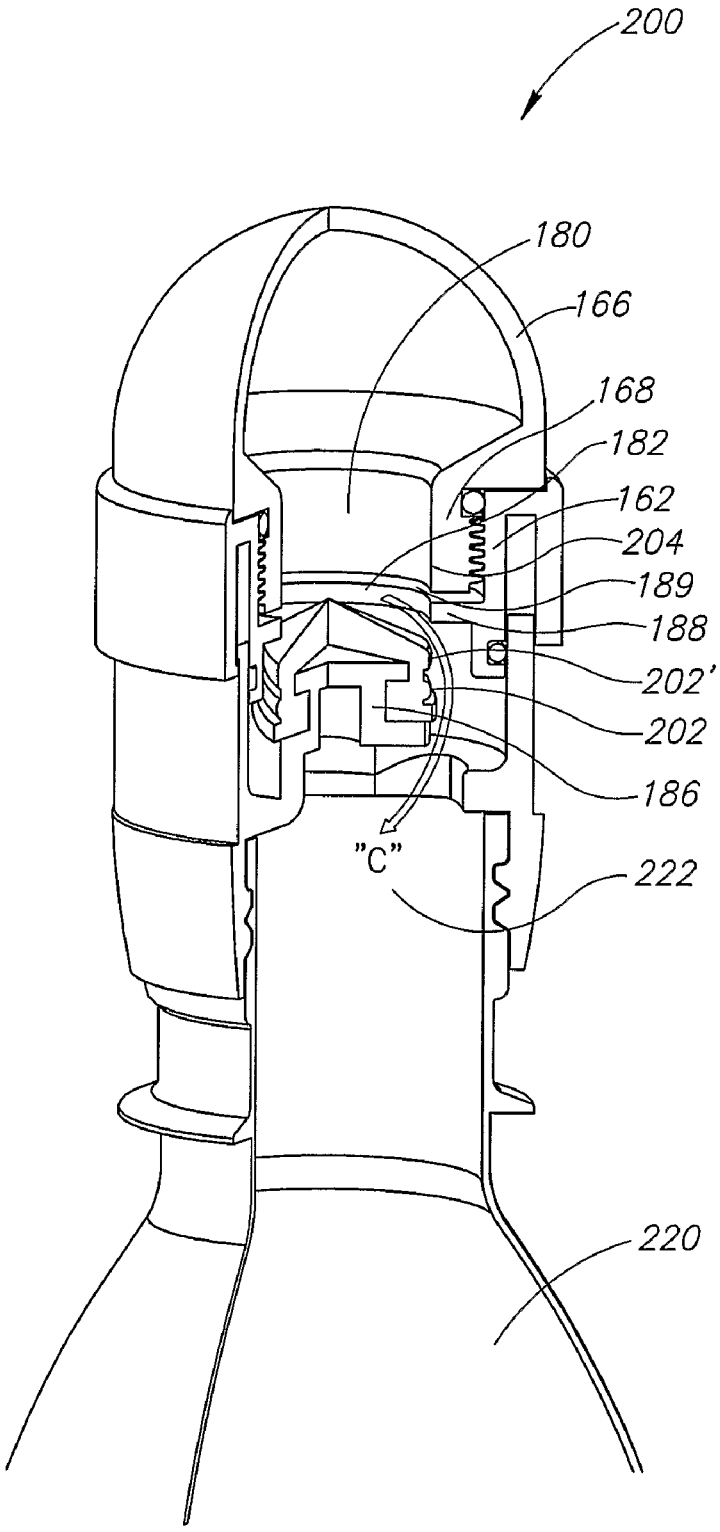
FIG. 10 is a partial cutaway illustration of the cartridge unit of FIG. 9, in a flow communication position.

FIG. 10 is a partial cutaway view of cartridge unit 200 sealingly coupled to a dispensing unit 220 as a two-compartment container assembly, wherein the displaceable member 162 is in the unsealed position. Axial upward displacement of displaceable member 162 disengages sealing ridge 202 from internal wall 189 of shoulder 188, and concurrently disengages sealing ridge 202' from the top opening of hollow closure 166, thereby unsealing passage 182. When cartridge unit 200 is mounted on dispensing unit 220, axially moving displaceable member 162 into the unsealed position provides for a flow-communication between compartment 180 inside cartridge unit 200 through open end 222, and the top opening of dispensing unit 220. This flow-communication, represented by arrow "C", allows for mixing of the component in the cartridge unit with the component in the dispensing unit to form a formulation which is ready for dispensing.

It is a particular feature of this embodiment that sealing member 186 is fixedly connected by supporting members 194 to annular shoulder 192 and is projecting upwardly. Such an arrangement provides for holding a substantial part of the component in compartment 180 in hollow closure 166, for allowing the user to readily inspect the component prior to use.

It is another particular feature of this embodiment, that hollow closure 166 may be filled with a component of the formulation, sealed by a peelable or other readily removable cover, and stored separately, while filling opening 164 of displaceable member 162 is sealed by a closure member, such as a disc closure member 44 illustrated in FIG. 1, so that compartment 180 is protected from entrance of undesired components or objects. Upon assembling the multi-compartment container and prior to use, while the displaceable member 166 is in the sealed position, closure member 44 may be removed and replaced by hollow closure 166 holding a component of the formulation, after removing its cover. Hollow closure 166 can be made of transparent or translucent material in any shape or form, wherein neck 168 is adapted and configured to sealingly engage filling opening 164 of displaceable member 162. Preferably, hollow closure 166 is a detachable closure member which is relatively inexpensive to manufacture. In this way, the cost of the cartridge unit can be reduced, as the user must purchase only one cartridge unit for multiple use, and a supply of relatively inexpensive, disposable hollow closures containing the component of the formulation.

An advantage of using a cartridge unit having a hollow closure according to this invention over the prior art multi-compartment containers is that the user can inspect the physical condition of the component in the cartridge unit prior to use. It will be appreciated that prior to use, the multi-compartment containers according to the invention can be positioned with the hollow closure downwards so as to allow the component to collect in the hollow closure, allowing the user to fully inspect it.

Another advantage of using a cartridge unit according to this invention is that a hollow closure is smaller in size than prior art cartridge units. Thus the hollow closure can be packed and shipped more efficiently than such cartridge units.

Figure 11:
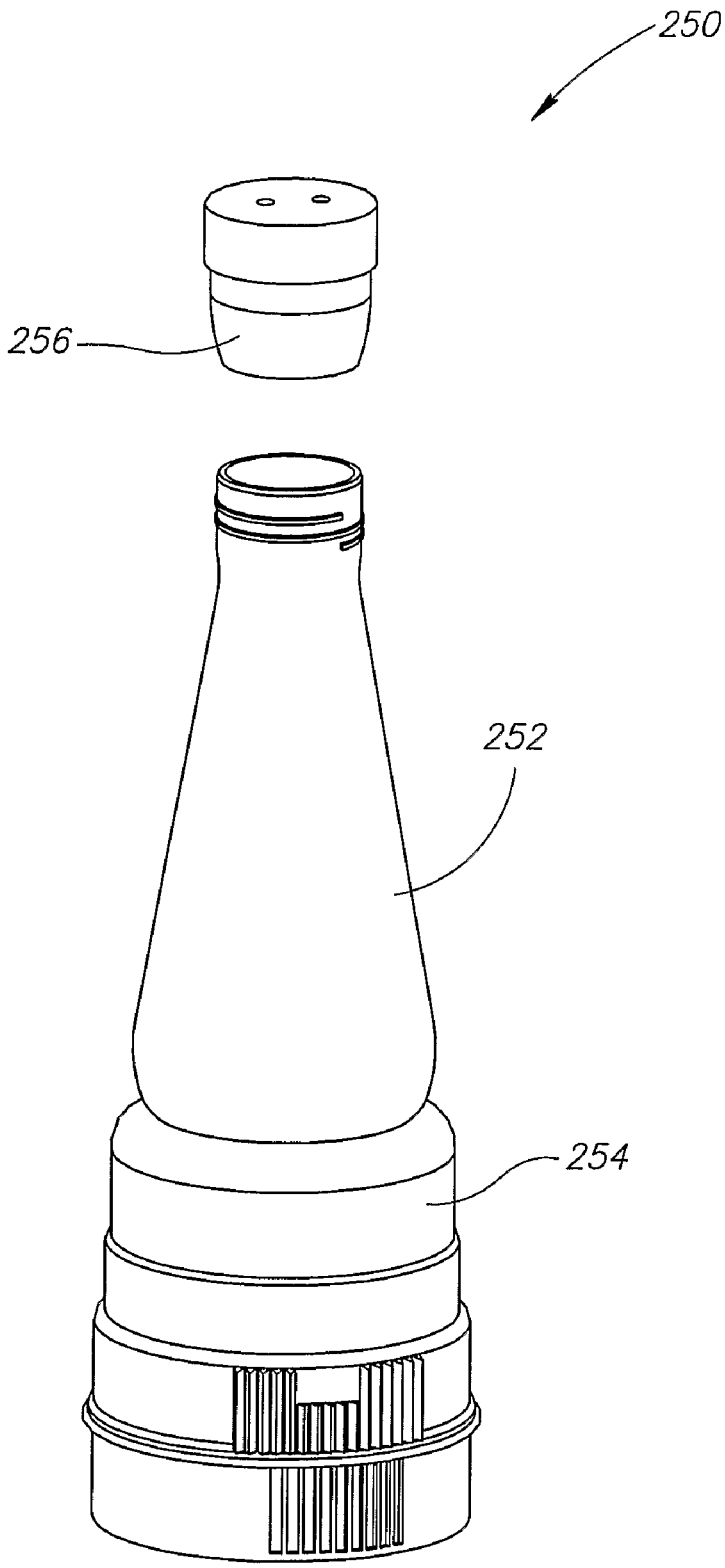
FIG. 11 is a plan view of a multi-compartment container assembly according to one embodiment of the invention.

Referring now to FIG. 11, there is shown a plan view of a multi-compartment container assembly 250 according to another embodiment of the invention. Multi-compartment container assembly 250 includes a dispensing unit 252 having a sealable open top end and a sealable open bottom end for receiving a cartridge unit on each end. Cartridge unit 254 on the bottom of dispensing unit 252 is illustrated herein as a prior art cartridge unit, while a cartridge unit 256 according to the present invention is sealingly coupled to the open top end of dispensing unit 252. The three assembly units of this embodiment may be filled with different components forming the formulation, and can be filled and sealed, and stored separately prior to assembly and use. Preferably, dispensing unit 252 is sealed on each end by means of easily removable seals or covers, as described in detail in the above US patent application. The assembly process may include opening the bottom seal of dispensing unit 252 when in an upside down position, so the component does not spill, and screwing cartridge unit 254 onto the bottom opening. Then, the top seal of dispensing unit 252 can be opened in the right side up position, and the dispensing unit 252 can be capped by screwing cartridge unit 256 to the top end, as described above. Cartridge units 254 and 256 can be operated in any desired sequence, to provide any desired combination of the components. It will be appreciated that cartridge unit 256 can be a cartridge unit according to any of the embodiments of the present invention, and can include a hollow closure, if desired, permitting the combination of four components, by providing an additional compartment in the dome.

On the other hand, it will be appreciated that one or two of the units can be empty, and only one material or two components provided in the compartments of multi-compartment container assembly 250. Thus, for example, the dispensing unit and one cartridge unit can each separately store a component of a mixture for mixing. Part or all the mixture can be transferred to the second cartridge unit. It will be appreciated that, after this transfer, the second cartridge unit may be removed from the container assembly, or the mixture may be dispensed from the second cartridge unit.

According to another non-limiting example, the dispensing unit can be empty and each of the cartridge units can contain a component of a mixture. In one scenario, part or all of the component in one of the cartridge units may be transferred into the empty dispensing unit. In the dispensing unit, this component can be mixed with the component in the second cartridge unit, and dispensed through the second cartridge unit. Or, this component can be mixed with part of the component in the second cartridge unit. Needless to say, there are a large number of additional combinations which are possible according to this embodiment, and not set forth expressly.

Figure 12:
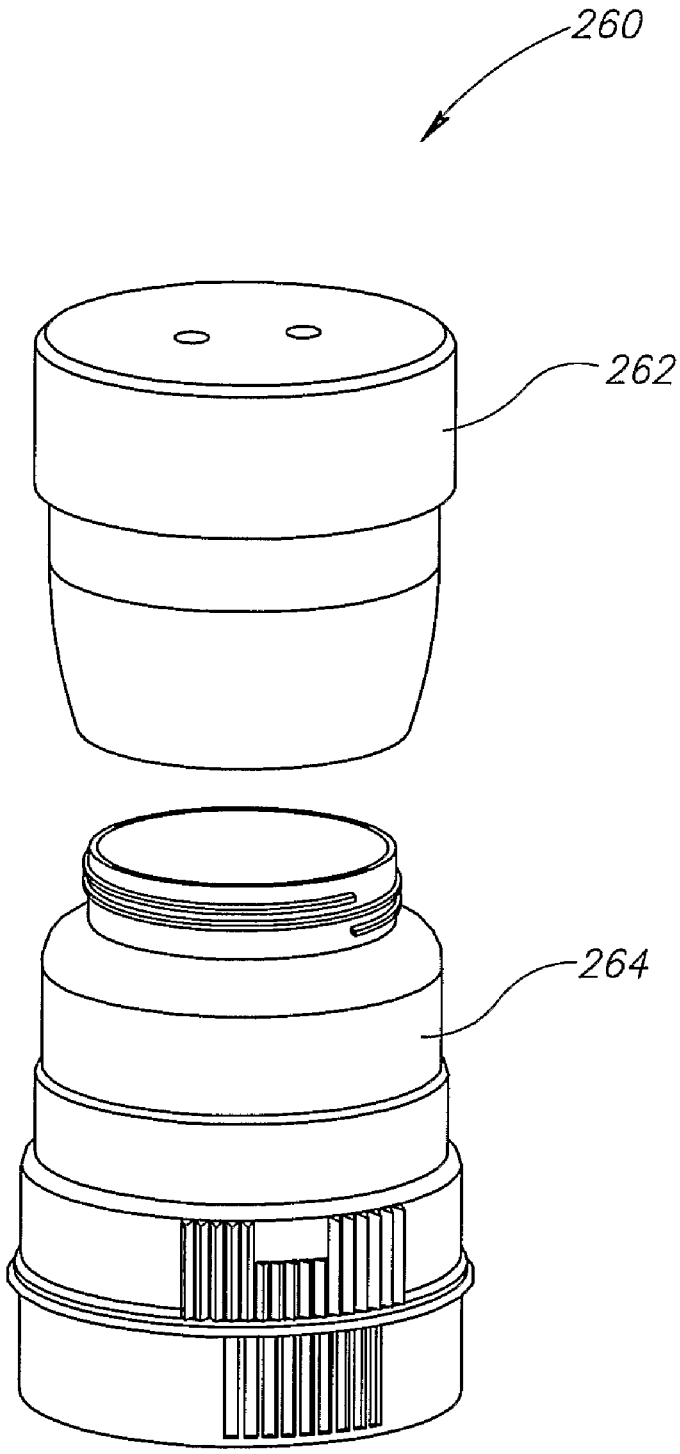
FIG. 12 is a plan view illustration of a multi-compartment container according to another embodiment of the invention, before assembly.

FIG. 12 is a plan view illustration of a multi-compartment container 260 according to yet another embodiment of the invention, before assembly. Container 260 includes a first cartridge unit 262 according to the present invention arranged to be coupled to a second cartridge unit 264, here shown as a cartridge unit according to the prior art. The assembly units of this embodiment may be filled with two different components forming the formulation, and can be filled and sealed, and stored separately prior to assembly and use. As stated with regard to FIG. 11, the cartridge units 262 and 264 may be any cartridge units described herein, and may include a hollow closure to permit inspection of the component in cartridge unit 262 and/or to provide a third compartment for an additional component. Alternatively, one of the cartridge units may be empty, with a material being stored in the second cartridge unit for transfer between the units when there is flow communication between the two. Alternatively, if desired, one cartridge unit can be a large cartridge unit filled with a material, while the second is a smaller cartridge unit. In this case, a quantity of the material may be transferred from the large cartridge unit to fill the smaller cartridge unit, which may then be sealed and removed. The small cartridge unit may now be replaced by another small, empty cartridge unit, and this process can be repeated until all the material in the large cartridge unit is exhausted. Preferably the smaller cartridge unit is designed to hold a pre-selected quantity of the material.

The present invention also provides a process for preparing a cartridge unit for holding and storing a material, until the cartridge unit is mounted on an assembly unit. The process includes providing a cartridge unit having a substantially cylindrical housing, the housing having a sealable opening at its top end, an inwardly extending annular shoulder defining a flow passage in the cartridge unit, and an opening at its bottom end. The cartridge unit also has a sealing member, which is adapted and configured for sealing engagement with the annular internal wall of the annular shoulder for sealing the flow passage, thereby defining a compartment in the cartridge unit. The displaceable member is inserted in the housing and is movable between a first position whereby a seal is formed between the sealing member and the internal wall of the annular shoulder, and a second position in which the sealing member and the internal wall are disengaged, whereby the compartment inside the cartridge unit is in flow communication with the bottom open end of the housing. The displaceable member has a sealable filling opening at its top end and a complementary closure member.

Next, one component of a mixture is introduced into the cartridge unit through the sealable filling opening of the displaceable member, which is sealed thereafter by the closure member. The displaceable member is seated in the housing such that the sealing member seals the flow passage. This forms the compartment inside the cartridge unit, into which the component is poured through the filling opening. The sealable filling opening is then sealed by the closure member.

Alternatively, a hollow closure may be provided which holds the component and is sealingly coupled to the filling opening of the displaceable member.

The filled cartridge unit is now coupled to an assembly unit until the mixture is needed. Alternatively, a cartridge unit may be coupled to an assembly unit while empty, and the closure member removed in order to fill a compartment in the cartridge unit, when desired. Alternatively, the closure member may be removed and replaced by a hollow closure which holds the component, immediately prior to use. In another embodiment, the filled cartridge unit may be coupled to an empty assembly unit.

After the user has assembled the cartridge unit and the assembly unit into a multi-compartment container and mixed and dispensed the contents of the assembly, the cartridge unit and assembly unit can be reused. The cartridge unit and assembly unit may be disassembled and then refilled. The refilling process may be the same as the process described above. According to one embodiment of the invention, the cartridge unit is merely rinsed, but not refilled, and the component to be added through the cartridge unit is provided stored inside a dome or other enlarged closure member.

It will be appreciated that the above descriptions are intended only to serve as examples and that many other embodiments are possible and encompassed within the spirit and the scope of the present invention. The cartridge unit described herein and illustrated in the figures is an example only. Cartridge units embodying other variations of the structures described here are within the scope of the present invention.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is;

1. A cartridge unit for a multi-compartment container assembly, the cartridge unit comprising:

a substantially cylindrical housing having a sealable opening at its top end and an opening at its bottom end;

a displaceable member disposed in said sealable opening in the top end of said housing, said displaceable member having a sealable opening at its top end, sealable with a closure member, said displaceable member being adapted and configured to seal said sealable opening of said housing;

an inwardly extending annular shoulder, said annular shoulder having an annular internal wall, and defining a flow passage along a longitudinal axis of the cartridge unit;

a sealing member adapted for a sealing engagement with said internal wall of said annular shoulder for sealing said flow passage, thereby defining a bottom wall of a compartment in the cartridge unit;

said displaceable member being axially displaceable between two positions along said longitudinal axis through the cartridge unit, a first position whereby a seal is formed between said sealing member and the internal wall of said annular shoulder, and a second position in which said sealing member and said internal wall are disengaged, whereby the compartment inside the cartridge unit is in flow communication with the bottom open end of the housing.

2. The cartridge unit according to claim 1, wherein said sealing member is adapted and configured to provide, concurrently, a second seal.

3. The cartridge unit according to claim 1, wherein said bottom end of said housing is adapted and configured to engage and seal an assembly unit, and wherein, in said second position, said sealing member and said internal wall are disengaged, whereby the compartment inside the cartridge unit is in flow communication with the assembly unit through the bottom open end of the housing.

4. The cartridge unit according to claim 3, wherein said assembly unit stores a component, and said flow communication allows mixing of a component in the cartridge unit with the component in the assembly unit.

5. The cartridge unit according to claim 1, wherein said sealing member is coupled to said displaceable member by at least one supporting member, and projects towards said flow passage.

6. The cartridge unit according to claim 1, wherein said sealing member is coupled to said housing by at least one supporting member, and projects towards said flow passage.

7. The cartridge unit according to either claim 5, wherein said sealing member includes a stem having a groove about its circumference for receiving a sealing element.

8. The cartridge unit according to either claim 6, wherein said sealing member includes a stem having a groove about its circumference for receiving a sealing element.

9. The cartridge unit according to claim 7, wherein said sealing element includes at least one sealing ridge.

10. The cartridge unit according to claim 8, wherein said sealing element includes at least one sealing ridge.

11. The cartridge unit according to claim 7, wherein said sealing element includes two sealing ridges, a first for providing a seal between said sealing member and said internal wall of said annular shoulder, and a second for concurrently providing a seal between said sealing member and said assembly unit.

12. The cartridge unit according to claim 8, wherein said sealing element includes two sealing ridges, a first for providing a seal between said sealing member and said internal wall of said annular shoulder, and a second for concurrently providing a seal between said sealing member and said assembly unit.

13. The cartridge unit according to claim 3, wherein said sealing member includes two grooves, each adapted to receive a sealing O-ring, a first for providing a seal between said sealing member and said internal wall of said annular shoulder, and a second for providing a seal between said sealing member and said assembly unit.

14. The cartridge unit according to claim 1, wherein said sealing member is a disc and includes at least one groove adapted to receive a sealing O-ring.

15. The cartridge unit according to claim 1, wherein said closure member is a hollow closure member adapted and configured to sealingly engage the filling opening of the displaceable member.

16. The cartridge unit according to claim 15, wherein said hollow closure member is adapted and configured to hold a material, and may be sealed by a removable cover.

17. The cartridge unit according to claim 16, wherein said sealing element includes two sealing ridges, a first for providing a seal between said sealing member and said internal wall of said annular shoulder, and a second for concurrently providing a seal between said sealing member and said hollow closure member.

18. The cartridge unit according to claim 17, wherein said sealing member includes two grooves, each adapted to receive a sealing O-ring, a first for providing a seal between said sealing member and said internal wall of said annular shoulder, and a second for providing a seal between said sealing member and said hollow closure member.

19. The cartridge unit according to claim 1, wherein said closure member is a disc closure member.

20. The cartridge unit according to claim 1, wherein said closure member is a membrane.

21. The cartridge unit according to claim 1, wherein said closure member is translucent.

22. The cartridge unit according to claim 1, wherein said closure member is transparent.

23. The cartridge unit according to claim 1, wherein said displaceable member and said cylindrical housing are adapted and configured to provide a security mechanism to securely hold the sealing member in the sealed position and prevent inadvertent unsealing of said flow passage.

24. The cartridge unit according to claim 1, wherein said displaceable member and said cylindrical housing are adapted and configured to securely hold the sealing member in the sealed position by means of a bayonet lock connection.

25. The cartridge unit according to claim 1, wherein said displaceable member further includes a manipulable depending skirt, said skirt being adapted and configured to be controlled by a user to move said displaceable member.

26. The cartridge unit according to claim 1, wherein:

said inwardly extending annular shoulder is formed in said housing; and said sealing member is formed on said displaceable member.

27. The cartridge unit according to claim 1, wherein:

said inwardly extending annular shoulder is formed on said displaceable member; and said sealing member is formed in said housing.

28. A process for preparing a cartridge unit for a multi-compartment container assembly, the process comprising:

providing a substantially cylindrical housing having a sealable opening at its top end and an opening at its bottom end;

disposing a displaceable member in said sealable opening in the top end of said housing, said displaceable member having a sealable opening at its top end, sealable with a closure member, said displaceable member being adapted and configured to seal said sealable opening of said housing;

providing an inwardly extending annular shoulder, said annular shoulder having an annular internal wall, and defining a flow passage along a longitudinal axis of the cartridge unit;

providing a sealing member adapted for a sealing engagement with said internal wall of said annular shoulder for sealing said flow passage, thereby defining a bottom wall of a compartment in the cartridge unit;

said displaceable member being axially displaceable between two positions along said longitudinal axis through the cartridge unit, a first position whereby a seal is formed between said sealing member and the internal wall of said annular shoulder, and a second position in which said sealing member and said internal wall are disengaged, whereby the compartment inside the cartridge unit is in flow communication with the bottom open end of the housing.

29. The process according to claim 28, further comprising:

(c) introducing a material into the cartridge unit through the sealable filling opening of the displaceable member; and (d) sealing the sealable filling opening.

30. The process according to claim 29, wherein the steps of introducing and sealing include sealing the filling opening with a hollow closure member holding a material.

31. The process according to claim 28, further comprising locking said displaceable member relative to said housing to prevent inadvertent displacement of the displaceable member.

32. The process according to claim 31, further comprising turning said displaceable member to unlock the bayonet lock, then pulling axially to unseal said passage, thereby providing flow communication between the compartment and said bottom open end of the housing.

33. The process according to claim 28, wherein:

said inwardly extending annular shoulder is formed in said housing; and said sealing member is formed on said displaceable member.

34. The process according to claim 28, wherein:

said inwardly extending annular shoulder is formed on said displaceable member; and said sealing member is formed in said housing.

* * * * *